United States Patent [19]

Tanaka et al.

[11] Patent Number: 4,972,492

[45] Date of Patent: Nov. 20, 1990

[54] EARPHONE

[75] Inventors: Masamichi Tanaka, Kanagawa; Kazuaki Kogure, Tokyo, both of Japan

[73] Assignees: Kabushiki Kaisha Toshiba, Kanagawa; Tsugaru Toshiba Sound Equipment Co., Ltd., Aomori, both of Japan

[21] Appl. No.: 322,957

[22] Filed: Mar. 14, 1989

[30] Foreign Application Priority Data

Mar. 15, 1988 [JP] Japan ..... 63-33814[U]

[51] Int. Cl.[5] ..... H04R 1/10; H04R 25/00

[52] U.S. Cl. ..... 381/187; 381/68.6; 181/130

[58] Field of Search ..... 381/183, 187, 68.6, 381/69, 68, 68.1, 68.2; 181/130, 135

[56] References Cited

U.S. PATENT DOCUMENTS 4,403,120 9/1983 Yoshimi ..... 381/187
4,516,428 5/1985 Konomi .
4,736,435 4/1988 Yokoyama et al. ..... 381/187

FOREIGN PATENT DOCUMENTS 0717540 9/1943 Fed. Rep. of Germany ..... 381/68.6
720072 12/1954 United Kingdom ..... 381/68.6

*Primary Examiner*—Jin F. Ng
*Assistant Examiner*—M. Nelson McGeary, III
*Attorney, Agent, or Firm*—Finnegan, Henderson, Farabow, Garrett and Dunner

[57] ABSTRACT

An earphone for use with audio reproduction devices. The earphone includes a housing, shaped to be retained in the concha cavity of the human ear, having an elongated portion shaped to fit between the tragus and antitragus of the ear, an audio transducer contained within the housing, a device for providing an electric signal to the audio transducer and a hollow tubular guide member attached to the housing such that when the elongated portion of the housing is inserted between the tragus and the antitragus of a human ear, the hollow tubular guide member extends into the external auditory meatus of the ear.

10 Claims, 4 Drawing Sheets

EARPHONE

FIELD OF THE INVENTION

The present invention relates generally to an earphone, and more particularly to an earphone for use with audio reproduction devices.

BACKGROUND OF THE INVENTION

Various types of earphones have been used in conjunction with audio reproduction apparatus in the past. The earphones are worn in the human ear to allow private sound reproduction.

Prior to explaining the structure and operation of earphones, the structure of the human ear will be briefly described with reference to FIGS. (1*a*) and 1(*b*). FIGS. 1(*a*) and 1(*b*) are front view and section of the leftside human ear. The rightside human ear is not shown, but has a similar structure symmetrical to the drawings. As shown in FIGS. 1(*a*) and 1(*b*), the human ear includes the auricle 10, the external ear 12 and the internal ear (not shown). The auricle 10 includes the tragus 14 and the antitragus 16 on both sides of the lower portion of the auricle 10. The tragus 14 and the antitragus 16 define the fossa 18 between them. The external ear 12 includes the concha cavity 20 and the external auditory meatus 22. An outer end of the concha cavity 20 is defined by the tragus 14 and the antitragus 16 and is connected to the fossa 18. An inner end of the concha cavity 20 is connected to the external auditory meatus 22. However, the external auditory meatus 22 is offset in the concha cavity 20 to the position near the tragus 14. The external auditory meatus 22 is terminated at the eardrum (not shown).

Referring now to FIGS. 2, 3 and 4, some typical examples of the conventional earphones will be described.

FIG. 2 shows a first example of the conventional earphone. As shown in FIG. 2(*a*), the earphone has a housing 30 for housing therein an audio transducer (not shown). The housing 30 may be shaped similarly to a marble. The marble-shaped housing 30 has a size to be retained in the concha cavity 20 of the human ear, as shown in FIG. 2(*b*).

The housing 30 is comprised of a front housing 32 for radiating sounds from the audio transducer and a rear housing 34. A hollow rod portion 36 is elongated from the rear housing 34. A signal cord 38 is connected to the audio transducer through the hollow rod portion 36. The hollow rod portion, i.e., the elongated portion 36, is positioned in the fossa 18 between the tragus 14 and the antitragus 16, when the earphone is worn in the ear. Then, the front housing 32 faces the external auditory meatus 22 of the ear.

The first conventional earphone of FIG. 2, however, has a drawback. That is, it is difficult to stably maintain the housing 30 in an accurate direction toward the external auditory meatus 22. This is because the external auditory meatus 22 is offset in the concha cavity 20, as described above. Further, the housing 30 easily fluctuates in the concha cavity 20. As a result, the sound level reproduced by the earphone and applied to the ear through the external auditory meatus 22 is reduced or the sound level easily fluctuates.

Furthermore, as the housing 30 does not fit in the concha cavity 20, a relatively large gap arises between the housing 30 and the concha cavity 20. The gap reduces the matching of the acoustic impedances between the earphone and the concha cavity 20 so that the frequency characteristic of the reproduced sound, particularly the characteristic in the low frequency range, is deteriorated.

FIG. 3 shows a second example of the conventional earphone. As shown in FIG. 3(*a*), the earphone has a housing 30 for housing therein an audio transducer (not shown). The housing 30 is shaped similar to a thick disc. The disc-shaped housing 30 has a size a little larger than the concha cavity 20 of the human ear. The housing 30 is worn in the ear by being engaged with the outside of the tragus 14 and the inside of the antitragus 16, as shown in FIG. 3(*b*).

The housing 30 is comprised of a front housing 32, for radiating sounds of the audio transducer, and a rear housing 34. A signal cord 38 is connected to the audio transducer through the rear housing 34. Further, the earphone has a tubular sound guide member 40. The tubular sound guide member 40 protrudes from the front housing 32 at the right axis of the housing 30. The tubular sound guide member 40 of the earphone is pushed into the external auditory meatus 22 of the ear so that the earphone is suspended on the ear by being engaged to the antitragus 16 and the external auditory meatus 22. In order to stably fit the earphone to the ear, the tubular sound guide member 40 has a relatively long length.

The second conventional earphone illustrated in FIG. 3 also has a drawback. That is, a user feels an unpleasant pressure sensation or a pain. This is because the earphone is worn in the ear with a relatively strong pressure. Particularly, the housing 30 is strongly pressed to the tragus 14 and the antitragus 16 for positioning the tubular sound guide member 40 in the external auditory meatus 22 which is offset in the concha cavity 20.

FIG. 4 shows a third example of the conventional earphone. As shown in FIG. 4(*a*), the earphone has a housing 30 for housing therein an audio transducer (not shown). The housing 30 is shaped similar to a thick disc. The disc-shaped housing 30 has a size to be retained in the concha cavity 20 of the human ear, as shown in FIG. 4(*b*).

The third conventional earphone has also a housing 30, an audio transducer (not shown) mounted in the housing 30, a signal cord 38 connected to the audio transducer without passing through an elongated portion, as shown in FIG. 4(*a*). The housing 30 is shaped similar to a thick disc, as the second one described above. However, the housing 30 has a smaller size than that of the second one so that the housing 30 entirely fits in the concha cavity 20 of the ear. Further, the earphone has a small tubular sound guide member 40. The small tubular sound guide member 40 is mounted to the front housing 30 at a position offset from the axis of the housing 30. Further the small tubular sound guide member 40 protrudes from the housing 30 in a slanted direction to the axis of the housing 30.

The housing 30 fits in the concha cavity 20 of the ear so that the small tubular sound guide member 40 is loosely fitted into the external auditory meatus 22, as shown in FIG. 4(*b*). On the other hand, the signal cord 11 is positioned above the tragus 14, as shown in FIG. 4(*c*).

The third conventional earphone of FIG. 4, also has a drawback. That is, it is difficult to stably wear the earphone in the ear. When an external force is applied to the earphone, the earphone can no longer be retained at a suitable position in the ear. Otherwise, the earphone falls from the ear. When the earphone is designed to fit stably in the ear, the housing 30 and the tubular sound guide member 40 must have a relatively large size. This, however, causes the same drawback as the earphone of FIG. 2. Thus, a user feels an unpleasant pressure sensation or a pain.

In addition, all the above-described conventional earphones are not proper in shape for using in a stereo earphone set. That is, a user finds it difficult in selecting the difference between the right and left earphones.

SUMMARY OF THE INVENTION

It is an object of the present invention to provide an earphone which is retained in a stable manner in the concha cavity of the human ear.

Another object of the present invention is to provide an earphone which gives a good matching of acoustic impedances between the earphone and the concha cavity of the human ear.

A further object of the present invention is to provide an earphone set suitable for use with stereo reproduction equipment.

In order to achieve the above objects, an earphone according to one aspect of the present invention includes a housing, shaped to be retained in the concha cavity of the human ear, having an elongated portion shaped to fit between the tragus and antitragus of the ear, an audio transducer contained within the housing, a device for providing an electric signal to the audio transducer and a hollow tubular guide member attached to the housing such that when the elongated portion of the housing is inserted between the tragus and the antitragus of the human ear, the hollow tubular guide member extends into the external auditory meatus of the ear.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
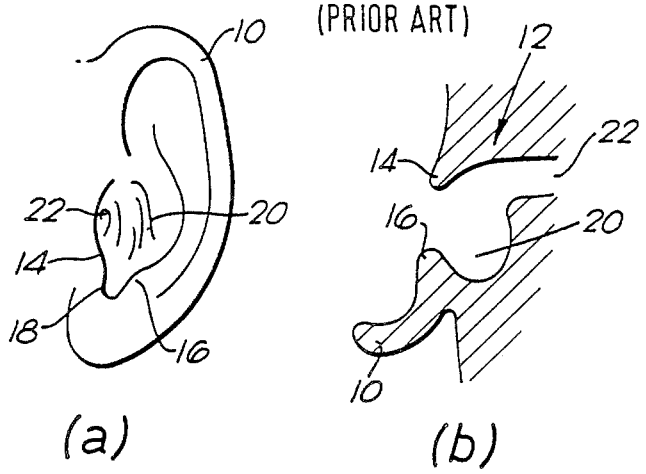
FIG. 1 (PRIOR ART)
FIGS. 1(*a*) and 1(*b*) are front view and section of the human ear.

The present invention will be described in detail with reference to FIGS. 5 through 9. Throughout the drawings, reference numerals or letters used in FIGS. 1, 2, 3 and 4 will be used to designate like or equivalent elements for simplicity of explanation.

Figure 5:
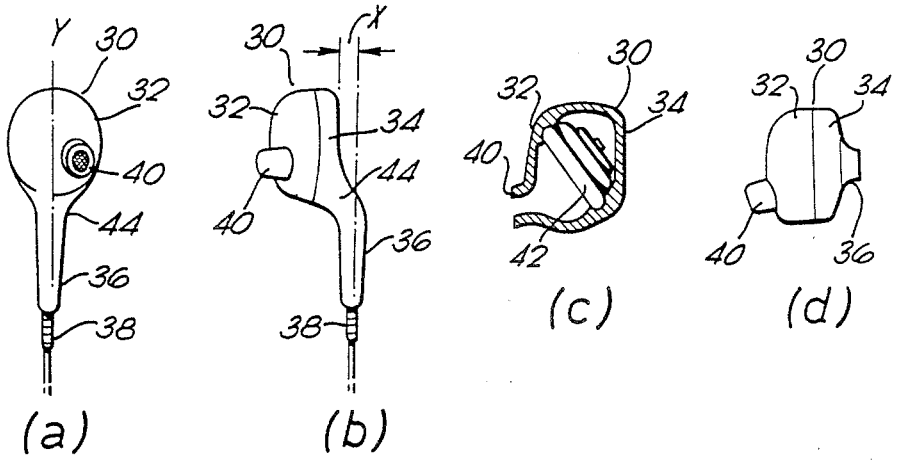
FIG. 5(*a*) through FIG. 5(*d*) are a front view, a side view, a section and a top view of one embodiment of the present invention.

Referring now to FIG. 5, a first embodiment of the earphone according to the present invention will be described in detail. FIG. 5(*a*) shows a front view of the earphone for the left ear. FIG. 5(*b*) shows a side view of the earphone. FIG. 5(*c*) shows a section of the earphone. FIG. 5(*d*) shows a top view of the earphone.

Figure 6:
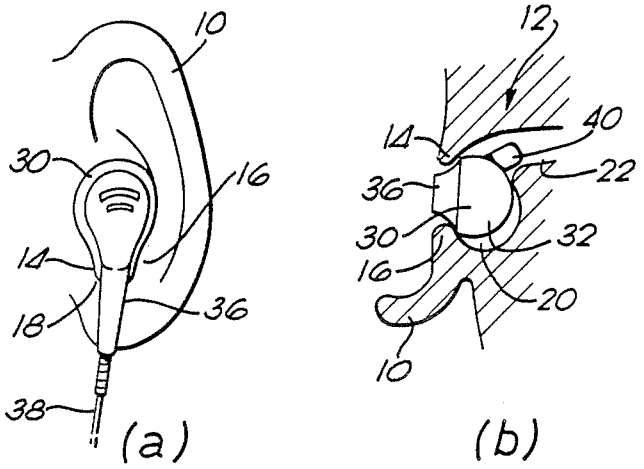
FIGS. 6(*a*) and 6(*b*) are drawings showing examples of use of the earphone of the present invention, respectively.

As shown in FIGS. 5(*a*) through 5(*d*), the embodiment of the earphone has a housing 30 for housing therein an audio transducer 42. The housing 30 is shaped, e.g., like a button. The button-shaped housing 30 has a size to be retained in the concha cavity 20 of the human ear, as shown in FIGS. 6(*a*) and 6(*b*), which show the earphone in use.

The housing 30 is comprised of a front housing 32 and a rear housing 34. A hollow rod portion 36 is elongated from the rear housing 34. The hollow rod portion, i.e., the elongated portion 36, is connected to the rear housing 34 through a crank section 44. Therefore, the axis of the elongated portion 36 is offset from the housing 30 by a predetermined distance X, as shown in FIG. 5(*b*). The elongated portion 36 is positioned in the fossa 18 between the tragus 14 and the antitragus 16 when the housing 30 is retained in concha cavity 20. A signal cord 38 is connected to the audio transducer 42 through the elongated portion 36.

Further, the earphone has a small tubular sound guide member 40. The tubular sound guide member 40 protrudes from the front housing 32, at a position offset to the right from the vertical center line Y passing through the elongated portion 36 of the housing 30, as shown in FIG. 5(*a*). The rightward offset position is such that the tubular sound guide member 40 just opposes the external auditory meatus 22 of the left ear. This is because the external auditory meatus 22 of the left ear is offset to the left of center in the concha cavity 20. Thus, the tubular sound guide member 40 may be smoothly inserted into the external auditory meatus 22 of the left ear, with the housing 30 retained in concha cavity 20.

FIG. 5(*c*) shows a cross-sectional view of the earphone. As shown in the drawing, the audio transducer 42 is directed to the tubular sound guide member 40. This construction provides a good transmission of the sound reproduced by the audio transducer 42 to the external auditory meatus 22 of the ear.

Figure 2:
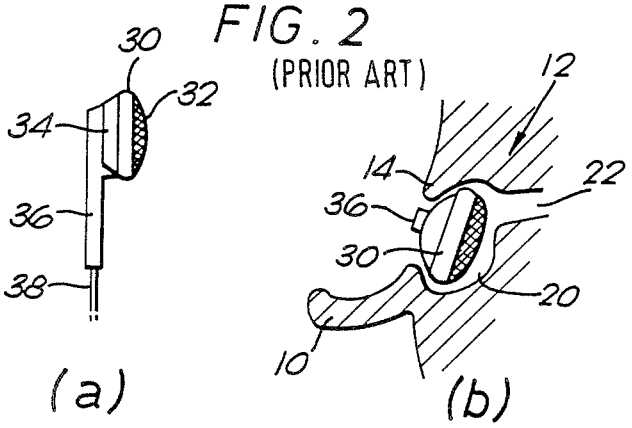
FIG. 2 (PRIOR ART)
FIGS. 2(*a*) and 2(*b*) are explanatory drawings showing a first conventional earphone.
Figure 3:
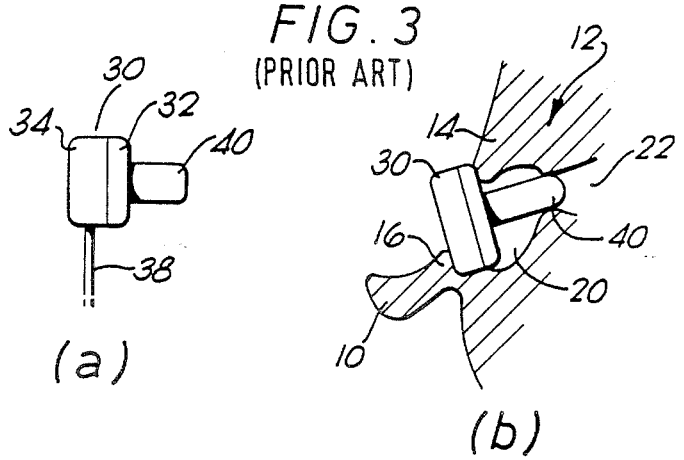
FIG. 3 (PRIOR ART)
FIGS. 3(*a*) and 3(*b*) are explanatory drawings showing a second conventional earphone.
Figure 4:
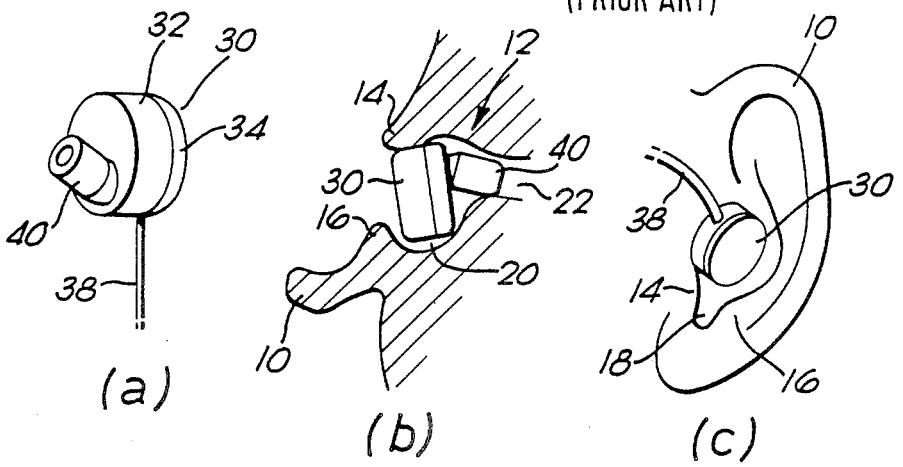
FIG. 4 (PRIOR ART)
FIGS. 4(*a*), 4(*b*) and 4(*c*) are explanatory drawings showing a third conventional earphone.

According to the embodiment of the earphone according to the present invention, the position of the earphone is stabilized by placing the elongated portion 36 in the fossa 18 between the tragus 14 and the antitragus 16 when the earphone is inserted into the ear, as shown in FIG. 6(*b*). Then, the housing 30 and the tubular sound guide member 40 are comfortably seated in the concha cavity 20 and the external auditory meatus 22, respectively, as shown in FIG. 2(*c*).

Since the housing 30 and the tubular sound guide member 40 are well seated in their places, their sizes are set to the sizes of the concha cavity 20 and the external auditory meatus 22, respectively, for less discomfort to the wearer.

Figure 7:
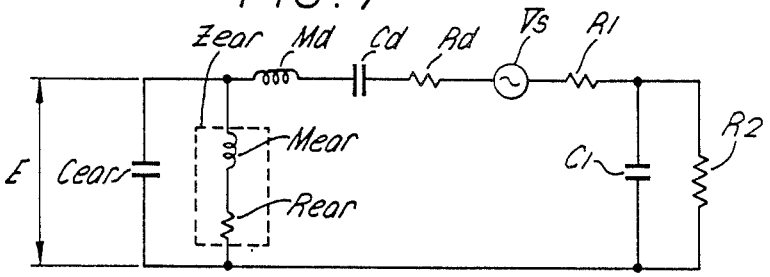
FIG. 7 is an electrical equivalent circuit representing the acoustic system including the earphone and the ear.

FIG. 7 shows an electrical equivalent circuit presenting the acoustic system including the earphone and the ear, as shown in FIG. 6(*b*).

In the equivalent circuit of FIG. 7, an inductance Md, a capacitance Cd and a resistance Rd correspond to the mass, the compliance and the mechanical resistance of a diaphragm (not shown) of the audio transducer 42. A voltage source Vs corresponds to the signal voltage supplied to the audio transducer 42. A block Zear is the acoustic impedance of the ear viewed from the audio transducer 42. The acoustic impedance Zear comprises an inductance Mear and a resistance Rear corresponding, respectively, to the inertance and the acoustic resistance of the space left between the earphone and the ear. Further, a capacitance Cear is the acoustic capacitance in the ear viewed from the audio transducer 42. Resistances R1 and R2 are the acoustic resistances of the housing 30 and the tubular sound guide member 40. A capacitance C1 is the acoustic capacitance of the space in the housing 30.

According to the disclosed embodiment, the acoustic impedance of the external auditory meatus 22 viewed from the audio transducer 42 increases when compared with conventional earphones. This makes the voltage E across the resistance R2 in the equivalent circuit of FIG. 7 become high. This is because the space between the housing 30 and the concha cavity 20 is reduced so that leakage of the sound outside the ear is reduced.

Figure 8:
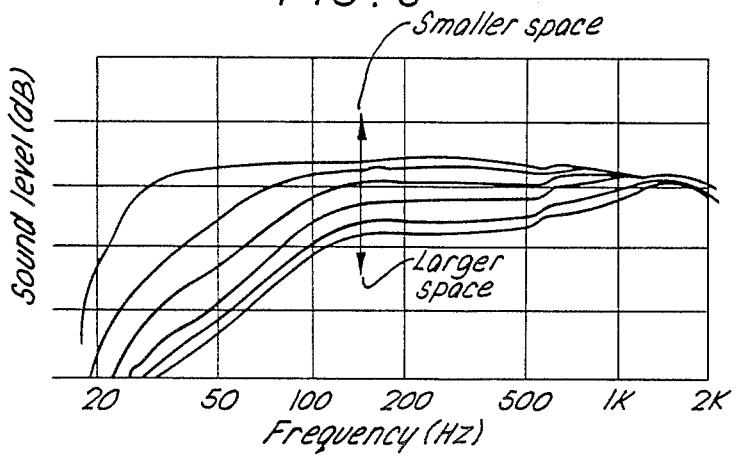
FIG. 8 is a graph showing the frequency characteristics of the acoustic system.

FIG. 8 shows a graph of frequency characteristics of the acoustic system. In the graph, each graph line shows a sound level responsive to the frequency of the sound radiated from the earphone, in tests carried out for test samples of earphones according to the present invention and the conventional earphones. The graph line rises as the space between the earphone and the concha cavity is reduced. The samples of the present invention produced the upper three of the graph lines, while the samples of the conventional earphones produced the lower three of the graph lines.

As shown by the tests, an earphone according to the present invention has good sound level characteristics in comparison to conventional earphones. Particularly, the improved earphone is superior to the prior art earphones in the low frequency range.

Figure 9:
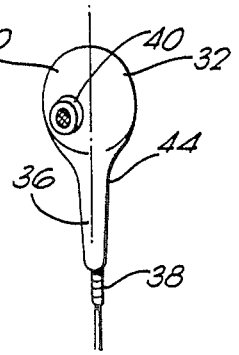
FIG. 9 is a front view showing the earphone according to the present invention for use in the rightside ear.

The above explanation was made for an earphone designed for use in the left ear. However, the present invention can be applied to the earphone for use in the right ear in a similar manner, as shown in FIG. 9. FIG. 9 shows the front view of the earphone for the right ear. The tubular sound guide member 40 of the earphone for the left ear is provided at a position offset rightward in the drawing from the vertical center line Y passing through the elongated portion 36 of the housing 30 (see FIG. 5(*a*)). On the other hand, the tubular sound guide member 40 of the earphone for the right ear is provided at a position offset leftward from the vertical center line Y passing through the elongated portion 36 of the housing 30 (see FIG. 9). Thus, the leftward offset position just opposes to the external auditory meatus 22 of the right ear. In other words, the tubular sound guide members 40 are symmetrically provided by offsetting rightward and leftward from the vertical center line Y passing through the elongated portion 36 of the housing 30 for the leftside and the rightside ears.

The present invention is also useful for a stereo earphone set. For example, if the user puts the earphone meant for use in the left ear into the right ear, the earphone does not comfortably match to the ear. Therefore, the user can easily find that the wrong earphone has been inserted into the ear.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

The foregoing description and the drawings are regarded by applicants as including a variety of individually inventive concepts, some of which may lie partially or wholly outside the scope of some or all of the following claims. The fact that applicants have chosen at the time of filing of the present application to restrict the claimed scope of protection in accordance with the following claims is not to be taken as a disclaimer of alternative inventive concepts that are included in the contents of the application and could be defined by claims differing in scope from the following claims, which different claims may be adopted subsequently during prosecution, for example for the purposes of a divisional application.

What is claimed is:

1. An earphone for use with audio reproduction devices, comprising:

a housing, shaped to be retained in the concha cavity of the human ear;

an elongated portion shaped to extend external to the concha cavity in a direction transverse to the axis of the external auditory meatus of the ear;

a crank portion extending between and connecting said elongated portion and said housing for offsetting said elongated portion a predetermined distance from said housing, said crank portion shaped to fit between the tragus and antitragus of the ear;

an audio transducer contained within the housing;

means for providing an electric signal to the audio transducer; and a hollow tubular guide member attached to the housing such that when the elongated portion of the housing is inserted between the tragus and the antitragus of a human ear, the hollow tubular guide member extends into the external auditory meatus of the ear.

2. The earphone of claim 1, wherein the audio transducer is positioned opposite the hollow tubular guide member.

3. An earphone as in claim 1, wherein the hollow tubular guide member is offset from the vertical center line passing through the elongated portion of the housing.

4. The earphone of claim 3, wherein the audio transducer is positioned opposite the hollow tubular guide member.

5. An earphone for use with audio reproduction devices, comprising:

a housing, shaped to be retained in the concha cavity of the human ear;

an elongated portion shaped to extend external to the concha cavity in a direction transverse to the axis of the external auditory meatus of the ear;

a crank portion extending between and connecting said elongated portion and said housing for offsetting said elongated portion a predetermined distance from said housing, said crank portion shaped to fit between the tragus and antitragus of the ear;

an audio transducer contained within the housing;

means for providing an electric signal to the audio transducer; and a hollow tubular guide member, for insertion into the human ear, attached to the housing in a position offset from the vertical center line passing through the elongated portion of the housing.

6. The earphone of claim 5, wherein the audio transducer is positioned opposite the hollow tubular guide member.

7. An earphone set for use with audio reproduction devices, comprising:

first and second housings, each being shaped to be retained in the concha cavity of the human ear;

first and second elongated portions shaped to extend external to the concha cavity in a direction transverse to the axis of the external auditory meatus of the ear;

first and second crank portions for respectively connecting the first and second housings to said first and second elongated portions, said crank portions for offsetting said elongated portions a predetermined distance from said housings, said crank portions shaped to fit between the tragus and antitragus of the ear;

an audio transducer contained within each housing;

means for providing an electric signal to each audio transducer; and a hollow tubular guide member attached to each housing such that when the elongated portion of each housing is inserted between the tragus and the antitragus of a human ear, the hollow tubular guide member extends into the external auditory meatus of the ear.

8. The earphone set of claim 7, wherein the first and second audio transducers are positioned opposite the first and second hollow tubular guide members, respectively.

9. An earphone set for use with audio reproduction devices, comprising:

first and second housings, each being shaped to be retained in the concha cavity of the human ear;

first and second elongated portions shaped to extend external to the concha cavity in a direction transverse to the external auditory meatus of the ear;

first and second crank portions for respectively connecting the first and second housings to the first and second elongated portions, said crank portions for offsetting said elongated portions a predetermined distance from said housings, said crank portions shaped to fit between the tragus and antitragus of the ear;

an audio transducer contained within each housing;

means for providing electric signals to each audio transducer; and first and second hollow tubular guide members, located on the first and second housings, respectively, for insertion into the human ear;

wherein the first hollow tubular guide member is located on a first side of the vertical line passing through the elongated portion of the first housing and the second hollow tubular guide member is located on a second side of the vertical line passing through the elongated portion of the second housing.

10. The earphone set of claim 9, wherein the first and second audio transducers are positioned opposite the first and second hollow tubular guide members, respectively.

* * * * *